US007131151B2

(12) United States Patent
Ferneau et al.

(10) Patent No.: US 7,131,151 B2
(45) Date of Patent: Nov. 7, 2006

(54) MULTIPLE LEVEL ROLL-IN COT

(75) Inventors: Richard Henry Ferneau, Washington Court House, OH (US); William Harry Benedict, Jamestown, OH (US); Eugene Van Dyne, Wilmington, OH (US); Elroy Edwin Bourgraf, Maineville, OH (US); Irvin Pollock, Wilmington, OH (US); Abe Arnold, Sabina, OH (US)

(73) Assignee: Ferno-Washington, Inc., Wilmington, OH (US)

( * ) Notice: Subject to any disclaimer, the term of this patent is extended or adjusted under 35 U.S.C. 154(b) by 0 days.

(21) Appl. No.: 11/005,717

(22) Filed: Dec. 7, 2004

(65) Prior Publication Data

US 2005/0241063 A1 Nov. 3, 2005

Related U.S. Application Data

(63) Continuation of application No. 10/833,665, filed on Apr. 28, 2004, now abandoned.

(51) Int. Cl.
*A61G 1/048* (2006.01)
*A61G 1/02* (2006.01)

(52) U.S. Cl. ..... 5/86.1; 5/428; 5/430; 296/20

(58) Field of Classification Search ..... 5/86.1, 5/611, 81.1 R, 11, 424, 425, 428–430, 625, 5/627; 296/20
See application file for complete search history.

(56) References Cited

U.S. PATENT DOCUMENTS 2,747,919 A * 5/1956 Ferneau et al. ..... 5/617
2,958,873 A 11/1960 Ferneau
3,039,119 A * 6/1962 Bourgraf et al. ..... 5/617
3,088,770 A 5/1963 Weil et al.
3,380,085 A * 4/1968 Ferneau et al. ..... 5/86.1
3,644,944 A 2/1972 Bourgraf et al.
3,759,565 A 9/1973 Ferneau
3,980,334 A 9/1976 Ferneau et al.
4,037,871 A 7/1977 Bourgraf et al.
4,052,097 A 10/1977 Weil et al.
4,097,941 A 7/1978 Merkel
4,192,541 A 3/1980 Ferneau
4,405,172 A * 9/1983 Ferneau ..... 296/20
4,767,148 A 8/1988 Ferneau et al.
5,432,966 A 7/1995 Berta et al.

(Continued)

FOREIGN PATENT DOCUMENTS

GB 2 281 201 A 3/1995

*Primary Examiner*—Robert G. Santos
(74) *Attorney, Agent, or Firm*—Dinsmore & Shohl LLP

(57) ABSTRACT

A multiple level elevating cot adapted to be rolled into emergency vehicles, the cot having a wheeled undercarriage supporting a cot frame having a leading end and a trailing end, and adapted to selectively secure the cot frame in a plurality of elevational positions. The cot frame includes a pair of side extension arms provided between the leading end and the trailing end, each of the side extension arms being adapted to slidably extend outwardly from a stowed position adjacent the cot frame to an extended position substantially perpendicular to the cot frame. The cot further includes a drop frame that may be lengthened and sidearm supports positionable in vertically-up, vertically-down, substantially horizontal, and a folded position relative to the cot frame. The cot frame may form a part of an integral stretcher or may serve as a carrier to which a separable top structure mounts.

3 Claims, 11 Drawing Sheets

U.S. PATENT DOCUMENTS

| | | | | |
|---|---|---|---|---|
| 5,435,027 | A | 7/1995 | Bourgraf et al. | |
| 5,509,159 | A | 4/1996 | Du-Bois | |
| 5,537,700 | A | 7/1996 | Way et al. | |
| 5,575,026 | A | 11/1996 | Way et al. | |
| 5,913,559 | A | 6/1999 | Sexton et al. | |
| 5,987,673 | A | 11/1999 | Smith | |
| 6,125,485 | A | 10/2000 | Way et al. | |
| 6,381,781 | B1 * | 5/2002 | Bourgraf et al. | 5/618 |
| 6,389,623 | B1 | 5/2002 | Flynn et al. | |
| 6,526,611 | B1 * | 3/2003 | Flynn et al. | 5/611 |
| 6,701,545 | B1 * | 3/2004 | Ferneau et al. | 5/86.1 |
| 6,735,794 | B1 * | 5/2004 | Way et al. | 5/86.1 |
| 6,908,133 | B1 * | 6/2005 | Morton et al. | 296/19 |
| 2004/0034935 | A1 * | 2/2004 | Ferneau et al. | 5/618 |
| 2005/0120480 | A1 * | 6/2005 | Benedict et al. | 5/611 |
| 2005/0241063 | A1 * | 11/2005 | Ferneau et al. | 5/86.1 |

* cited by examiner

MULTIPLE LEVEL ROLL-IN COT

CROSS REFERENCE TO RELATED APPLICATIONS

This application is a continuation of U.S. patent application Ser. No. 10/833,665, filed Apr. 28, 2004 (now abandoned).

BACKGROUND OF THE INVENTION

This invention relates to ambulance cots and more particularly with improvements to multi-level roll-in cots such as multi-positional sidearm supports and telescoping loading wheels.

Ambulance cots typically comprise an essentially rectangular patient support frame with wheeled collapsible-leg assemblies enabling the stretcher to be stowed or loaded into the back of an ambulance. Examples of such prior art cots are disclosed in U.S. Pat. Nos. 4,097,941, 4,192,541, 4,767,148, 5,537,700, and 5,575,026. Although the prior art cots have been generally adequate for their intended purposes, they have not been satisfactory in all aspects, such as a limited number of positions that that a sidearm support can be located, and the in ability of prior art cot to be loading without lift into an ambulance with an extended bumper.

SUMMARY OF THE INVENTION

The present invention alleviates or at least ameliorates the above-mentioned difficulties by providing a cot construction which include a cot frame supported by a stable undercarriage, which permit the cot frame to be raised and lowered to a plurality of positions of use. The cot frame may be provided with integral patient support features, such as positionable back, leg, and sidearm supports, or may be provided with a removable patient support structure which is detachably secured to the cot frame. Where a removable patient support structure or top is provided, the cot frame is provided with locking mechanism, which automatically locks the removable top to the cot frame when the top is seated on the frame, readily, accessible release means being provided to permit rapid detachment of the top from the cot frame.

In one embodiment of the present invention, disclosed is an elevating cot adapted to be rolled into emergency vehicles. The cot comprises a generally rectangular cot frame having a leading end and a trailing end; and a pair of sidearm supports provided to the cot frame between the leading end and the trailing end. Each of the sidearm supports is adapted to be positionable in vertically-up, vertically-down, substantially horizontal, and folded positions relative to the cot frame.

In another embodiment of the present invention, an elevating cot adapted to be rolled into emergency vehicles is disclosed. The cot comprises a generally rectangular cot frame having a leading end and a trailing end. The leading end comprises a drop frame adapted to be positionable in extended, middle, collapsed, and lengthened positions.

In still another embodiment of the present invention, an elevating cot adapted to be rolled into emergency vehicles is disclosed. The cot comprises a generally rectangular undercarriage having wheels, and a generally rectangular cot frame having a leading end and a trailing end. The leading end comprises a drop frame adapted to be positionable in extended, middle, collapsed, and lengthened positions. Leg members interconnect the cot frame and the undercarriage.

A latching device is adapted to selectively secure the leg members in a plurality of elevational positions. The cot further comprises a pair of sidearm supports provided to the cot frame between the leading end and the trailing end, each of the sidearm supports being adapted to be positionable in vertically-up, vertically-down, substantially horizontal, and folded positions relative to the cot frame.

These and other features and advantages of the invention will be more fully understood from the following description of some embodiments of the invention taken together with the accompanying drawings. It is noted that the scope of the claims is defined by the recitations therein, and not by the specific discussion of features and advantages set forth in the present description.

BRIEF DESCRIPTION OF THE DRAWINGS

The present invention is illustrated by way of example and not limitation in the accompanying figures, in which like references indicate similar elements, and in which.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiment(s) of the present invention.

DESCRIPTION OF THE PREFERRED EMBODIMENTS

Referring first to FIGS. 1*a*, 1*b*, 2*a*, and 2*b*, illustrated is a cot structure embodiment of the invention having an integral top structure, with parts broken away and others in dotted lines for purposes of illustration. The cot is indicated generally at 100, and has a rectangular undercarriage 1 mounting pairs of caster wheels 2 at its opposite ends. The undercarriage 1 includes opposing side frame members 3 and 4, which are interconnected by transverse frame members 5 and 6, the latter being best seen in FIG. 2.

Figure 2A:
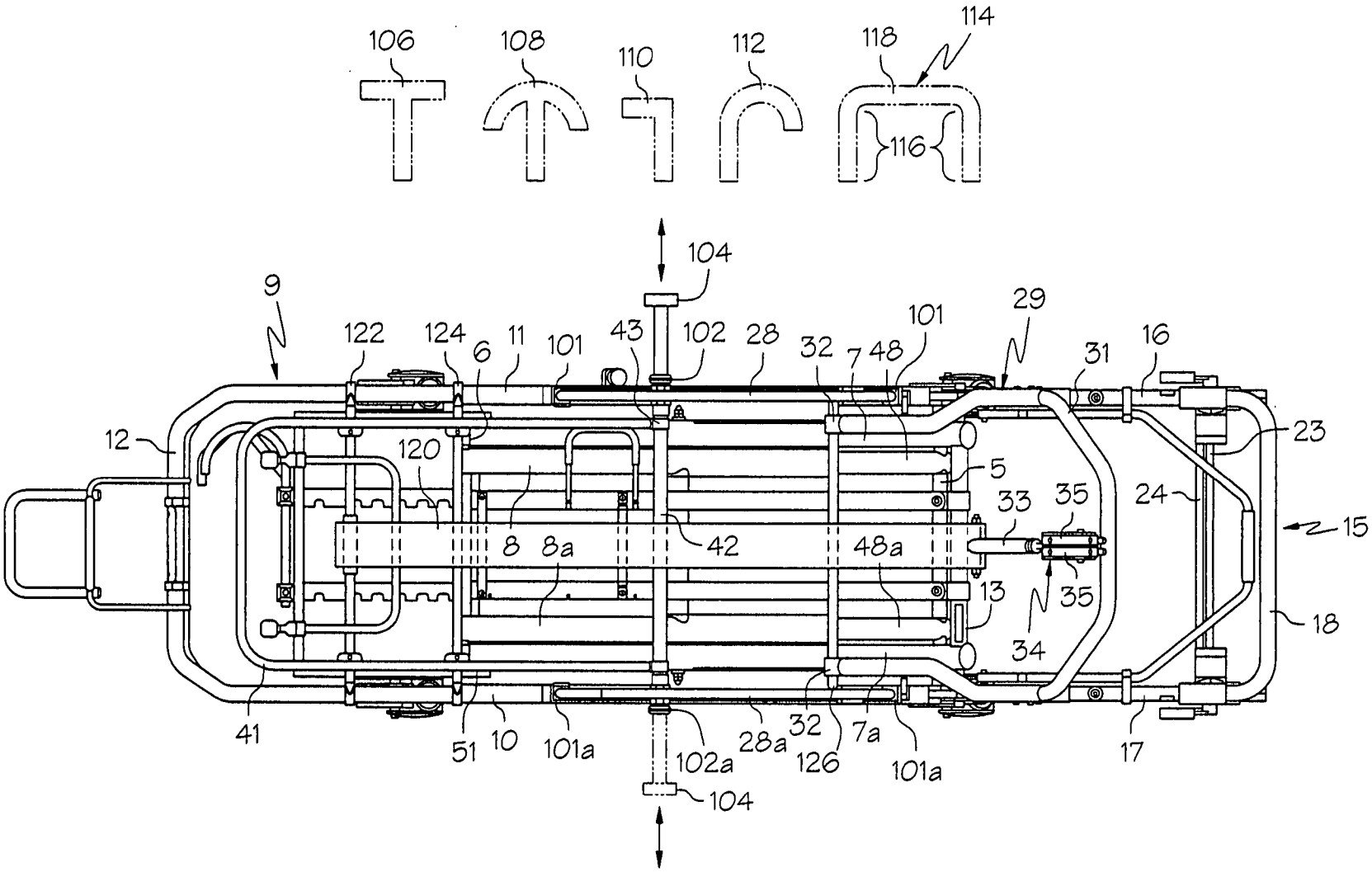
FIG. 2*a* is a top plan view of the embodiment of FIG. 1, with parts broken away to show underlying parts.
Figure 2B:
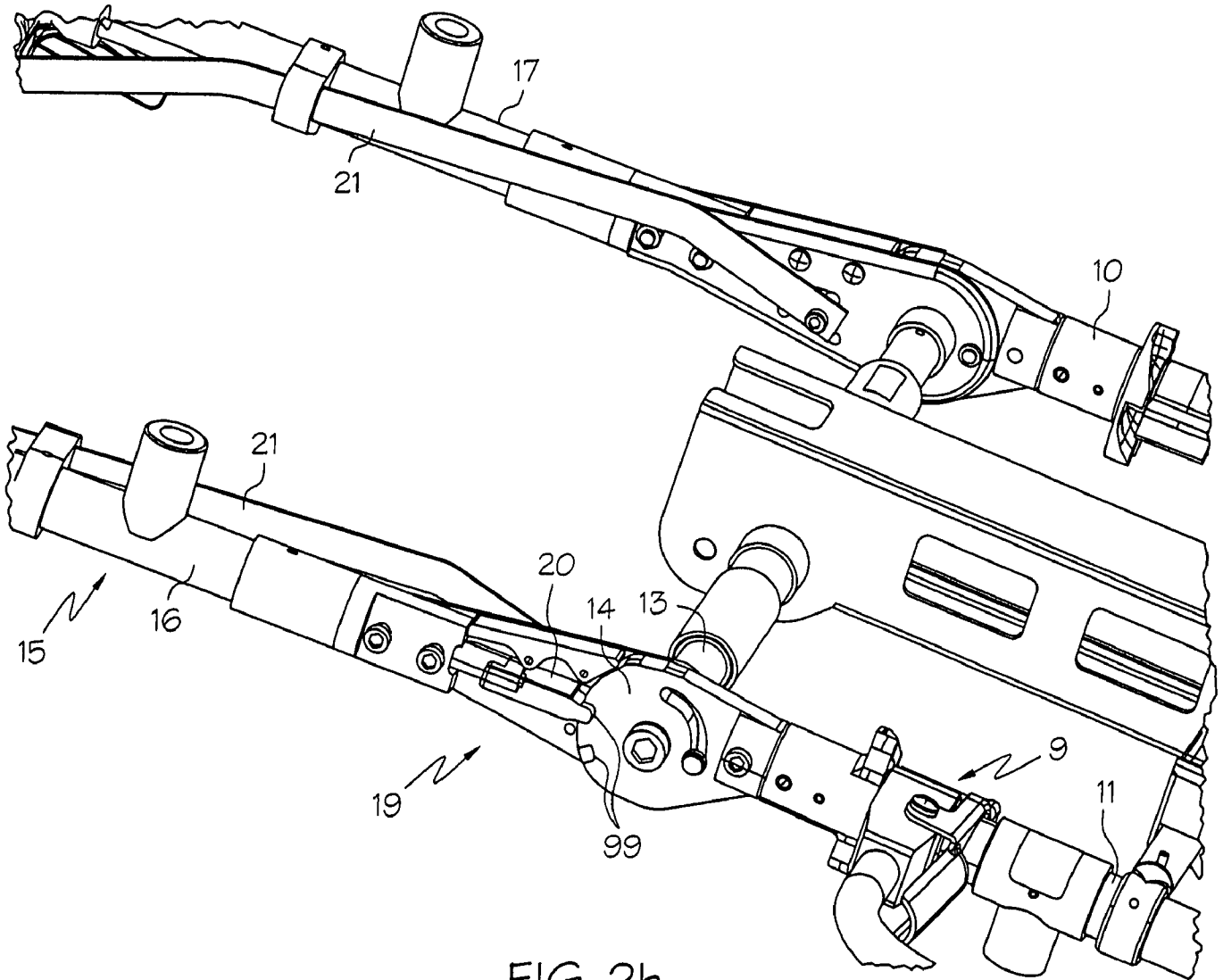
FIG. 2*b* is an enlarged fragmented perspective view of a portion of the embodiment of FIG. 2*a*, with parts removed to show underlying parts.

Extending upwardly from the undercarriage 1 are pairs of cross forming frame members 7, 8 and 7*a*, 8*a*, which serve to interconnect the undercarriage 1 with a cot frame 9. Cot frame 9 includes opposing tubular side frame members 10 and 11 interconnected at the foot or trailing end by a transverse tubular end member 12. At their leading or forward ends, the side rails 10 and 11 each terminate at a respective hinge pivot 14. As best seen by FIG. 2*b*, supported between the pair of hinge pivots 14 is a transverse frame 13 having a drop frame 15 rotatably coupled thereto. Drop frame 15 includes tubular side frame portions 16 and 17 joined at their forward ends by an end frame member 18 (FIG. 2*a*).

Figure 1A:
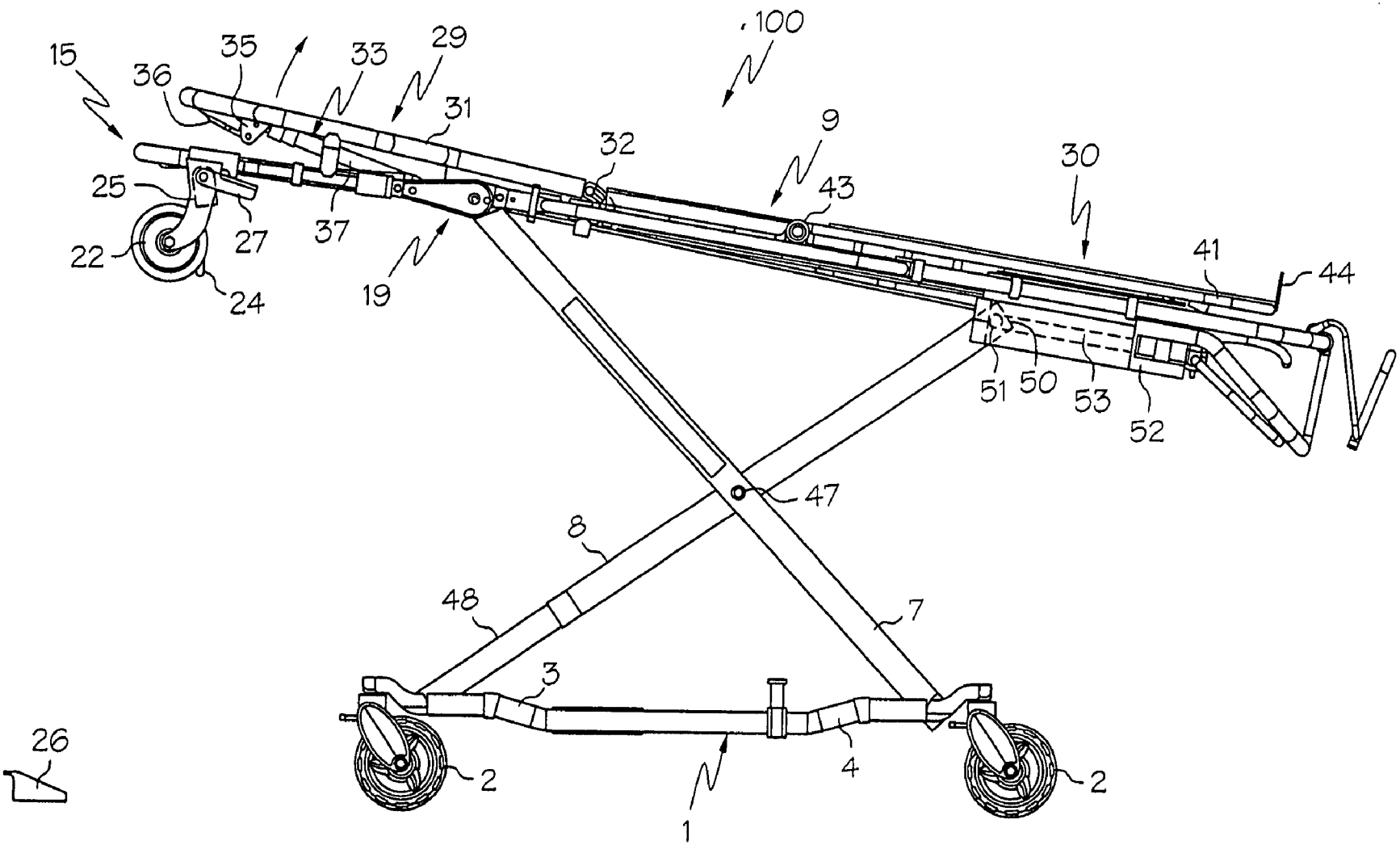
FIGS. 1*a* and 1*b* are side views of a cot structure embodiment of the invention having an integral top, with parts in dotted lines for purposes of illustration.

The drop frame 15 is releasably engaged by the pair of hinge pivots 14, which also limits the range of motion of drop frame 15. In particular, rotation of drop frame 15 is arrested by latch mechanism 19, which is best seen in FIG. 2*b*. Latch mechanism 19 permits the drop frame 15 to be moved from the extended position, as seen in FIGS. 1*a* and 2*a*, to a middle position, which is shown in dotted lines in FIG. 1*b*, or to a collapsed position also shown in FIG. 1*b*.

The drop frame 15 is locked either in the extended position or middle position by a spring biased latch 20 engaging a respective one of slots 99 provided in each pivot hinge 14. A release handle 21 provided to the drop frame 15 releases the sliding latch 20 from the engaged slot 99, such that the drop frame 15 may be repositioned. It is to be appreciated that positioning the drop frame 15 in the middle position provides a lower lifting handle position for improved ergonomics.

The drop frame 15 is provided with a pair of loading wheels 22 projecting downwardly from the outermost ends of side frame sections 16 and 17. The wheels 22 are interconnected by a rod 23 mounting a generally U-shaped tubular bail 24, which is spring biased to the downwardly extending position seen in FIGS. 1*a* and 1*b*. The tubular bail 24 is biased by springs 25, and is adapted to engage a tongue-like floor fitting 26 mounted on the floor of the emergency vehicle. The bail 24 also may be deflected upwardly by a release arm 27 positioned adjacent both sides of the cot frame, which permits the attendant to release the bail 24 from engagement with the floor fitting 26 when it is desired to remove the cot from the vehicle.

Figure 7:
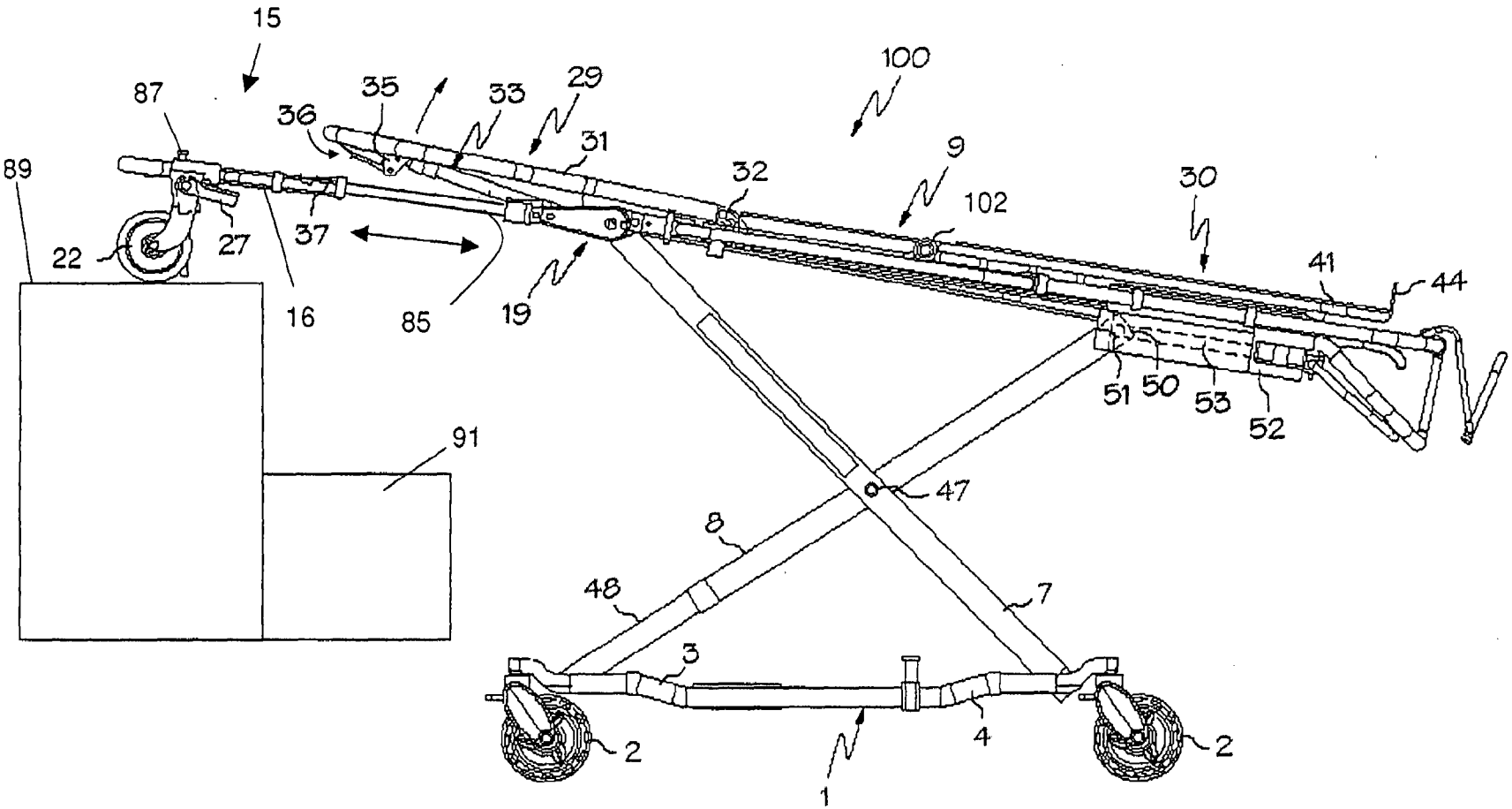
FIG. 7 is a side view of another cot structure embodiment according to the present invention having a telescoping drop frame.

In another embodiment, in addition to being positionable in the above-described extended, middle, and collapsed positions, the drop frame 15 is also expandable as illustrated by FIG. 7. A pair of tubular support members 85 is slidable accommodated within their respective tubular side frame portions 16 and 17, such that the drop frame may be lengthened. A release 87, such as a spring-biased pull pin or releasable collar, is lifted to extend the drop frame 15 from a compact position illustrated by FIG. 1*a*, to a fully lengthened position illustrated in FIG. 7, and a number of positions therebetween, if desired. With the drop frame 15 of the cot 100 in a lengthened position, the cot 100 may be situated conveniently on a raised surface 89 having an obstacle 91, such as for example, an extended bumper of an emergency vehicle, without having to lift the cot 100 over the obstacle 91.

It will be understood that the basic cot frame 9 may be provided with various adjustable features, such as folding sidearm supports 28, a multiple-position backrest, indicated generally at 29, and an adjustable leg section for placing the patient in a shock position, indicated generally at 30, all of which are conventional features. As best seen by FIG. 2*a*, the backrest 29 has a generally u-shaped frame member 31 hingedly connected at its ends to a traverse frame member 126 (FIG. 2*a*), respectively, by means of pivot fittings 32. The backrest 29 is movable from a reclined position shown in FIG. 1*a*, to an upright position illustrated in FIG. 1*b*.

Figure 1B:
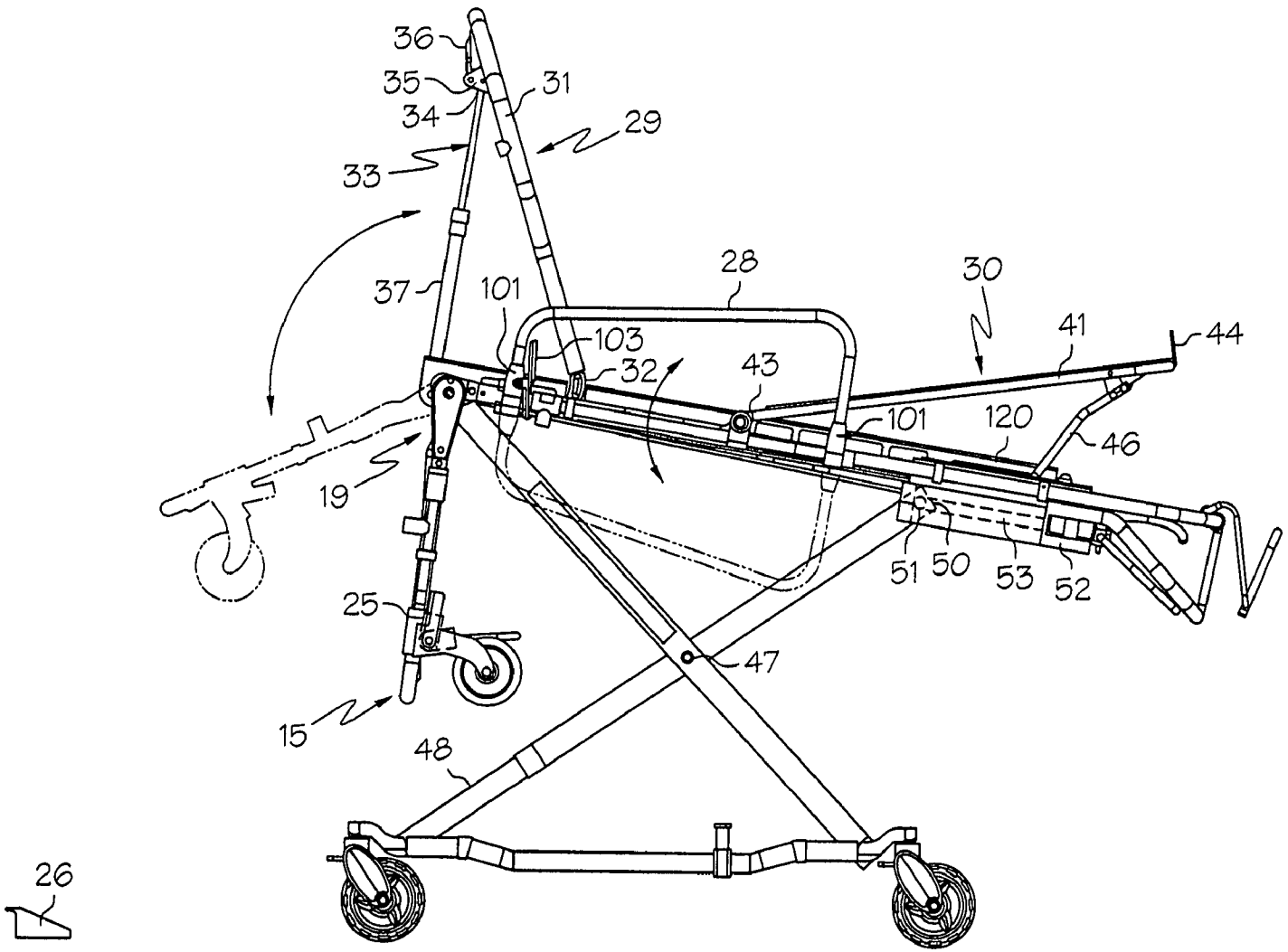

The backrest 29 is assisted from the reclined position to the upright position, and a plurality of positions therebetween indicated by the arrow line in FIGS. 1*a* and 1*b*, by a lifting device 33. The lifting device 33 is pivotally attached at an upper end 34 to a set of mounts 35. Mounts 35 are attached to the patient surface and the backrest frame 31 end position. Preferably, the lifting device 33 is a gas-assisted cylinder or alternatively, either a hydraulically or a mechanically assisted cylinder. In the illustrated embodiment of FIG. 1*b*, manipulation of a lever 36, also provided at the upper end of the lifting device 33, causes gas-assisted cylinder 37 to raise or lower the backrest 29 as desired. That is, depressing or raising the lever 36 operates a detent on the gas-assisted cylinder 37, which releases a locking mechanism internally on the cylinder and permits movement of the backrest 29. When the lever 36 is released, it moves back to a centered, at rest, position permitting a detent (not shown) on the cylinder to rise, locking the backrest 29 in place. The lower end of the lifting device 33 is connected to the cot frame 9 by a rotatable mount (not shown) so that it may rotate downward as it retracts permitting the backrest 29 to be placed in the reclined position.

The adjustable leg section 30 is formed by u-shaped frame members 41 (partially shown in FIG. 2) hingedly connected at its ends to a transverse hollow tubular member 42 by hinge members 43, as seen in FIG. 2. At the opposed end of the frame member 41, a footrest 44 is mounted. The footrest 44 is adapted to be raised and lowered by latch members 46 of known construction. Other features also may be provided, such as an auxiliary bail-like end frame member 40 underlying end frame member 12, which is positioned to be easily grasped by an attendant.

Referring to FIGS. 1*a* and 1*b*, the pairs of cross-forming frame members 7, 8 and 7*a*, 8*a* are pivotally connected by a pivot rod 47 at the point of intersection of the pairs of cross-forming frame members 7, 8 and 7*a*, 8*a*. In addition, the cross-forming frame members 8 and 8*a* telescopically receive tubular extensions 48 and 48*a* at their lowermost ends, which are pivotally connected to the transverse frame member 5 by fittings 49 and 49*a*, respectively. At their uppermost ends the cross-forming frame members 8 and 8*a* mount fittings 50 having guide pins 51 slidably received in elongated guide members 52 each provided with an elongated pin receiving slot 53.

Figure 4:
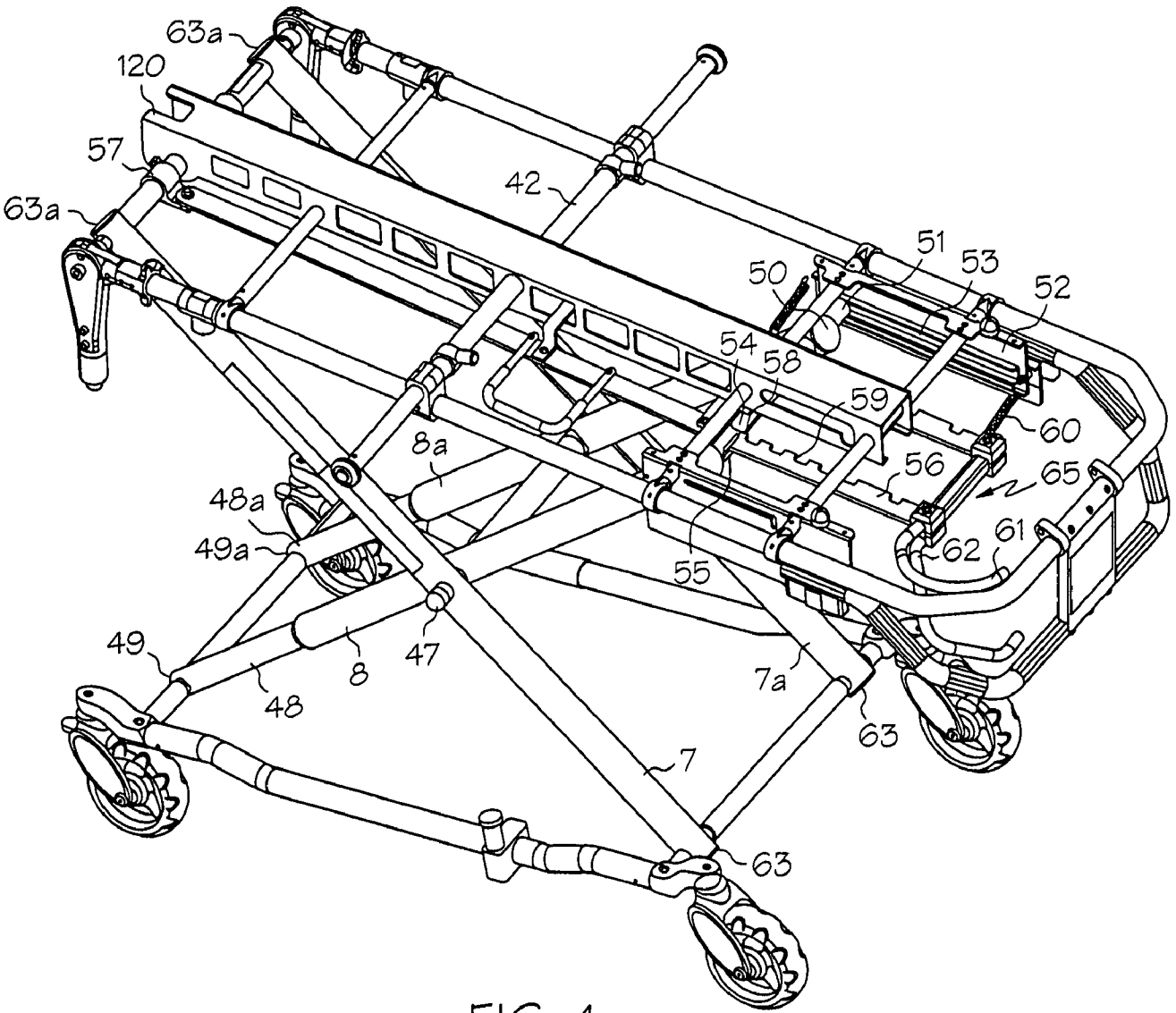
FIG. 4 is an elevational perspective view of another cot structure embodiment of the invention, with parts removed for purposes of illustration.

As best shown by FIG. 4, which has the same undercarriage arrangement of the embodiment of FIGS. 1*a* and 1*b*, pins 51 are interconnected to a latching device 65 adapted to selectively secure the cross-forming frame members 8 and 8*a* in a number of elevational positions. The latching device 65 is formed of a stabilizer 54 and locking bar 56. The stabilizer 54 includes a hollow passageway 55 that loosely receives the elongated locking bar 56. The locking bar 56 is connected at one end to a yoke 57 pivotally mounted on the transverse frame member 13. The locking bar 56 twists through substantially 90° intermediate its ends to provide a vertically disposed portion in engagement with the yoke 57 and a horizontally disposed portion extending through the passageway 55 in stabilizer 54. The passageway 55 has a latch pin 58 extending vertically therethrough for selective engagement with a series of notches or teeth 59 formed in the locking bar 56. A spring 60 is positioned to urge the notches in the locking bar into engagement with the pin. The locking bar 56 may be displaced laterally by means of loop-like release members 61 and 62, which are positioned to be grasped by the cot attendant either at the forward end of the cot or along one side thereof.

The lowermost ends of the cross-forming frame members 7 and 7*a* are pivotally connected to transverse frame member 6 of the undercarriage 1 by fittings 63. At their uppermost ends, the cross-forming frame members 7 and 7*a* are pivotally connected to the transverse frame member 13 of the cot frame by fittings 63*a*. The cross-forming frame members 7 and 7*a* may be reinforced intermediate their ends by sleeves 64, as seen in FIG. 3, an embodiment having substantially the same undercarriage arrangement of FIGS. 1*a* and 1*b*.

With latching device 65, the cot frame 9 of the various embodiments of the invention may be selectively secured in a plurality of elevational positions or collapsed against the undercarriage 1. This is accomplished by releasing the locking bar 56 and permitting the cross-forming frame members 8 and 8*a* to move to the outermost ends of the slots 53 in the elongated brackets 52. At the same time, extensible sections 48 and 48*a* telescope within the lowermost ends of cross-forming members 8 and 8*a*. As the cot 100 is elevated, the sets of cross-forming frame members 7 and 7*a* will elevate the cot frame relative to the undercarriage 1 in a generally horizontal plane. However, as the fully elevated positions of the cot frame are approached, e.g., such as the two innermost notches on the locking bar 56, the cot frame 9 will be inclined upwardly at its leading end, as illustrated in FIGS. 1*a*, 1*b*, 3, and 4. This upward inclination occurs due to the extensible cross-forming frame members 48 and 48*a*, and the relation of the pivot rod 47 to the points of intersection of the pairs of frame members 7, 8 and 7*a*, 8*a*. This upwardly inclined position elevates the loading wheels 22 to a higher position than if the cot frame remained horizontal and permitting the transfer of the cot into an emergency vehicle having an unusually high floor level.

Figure 3:
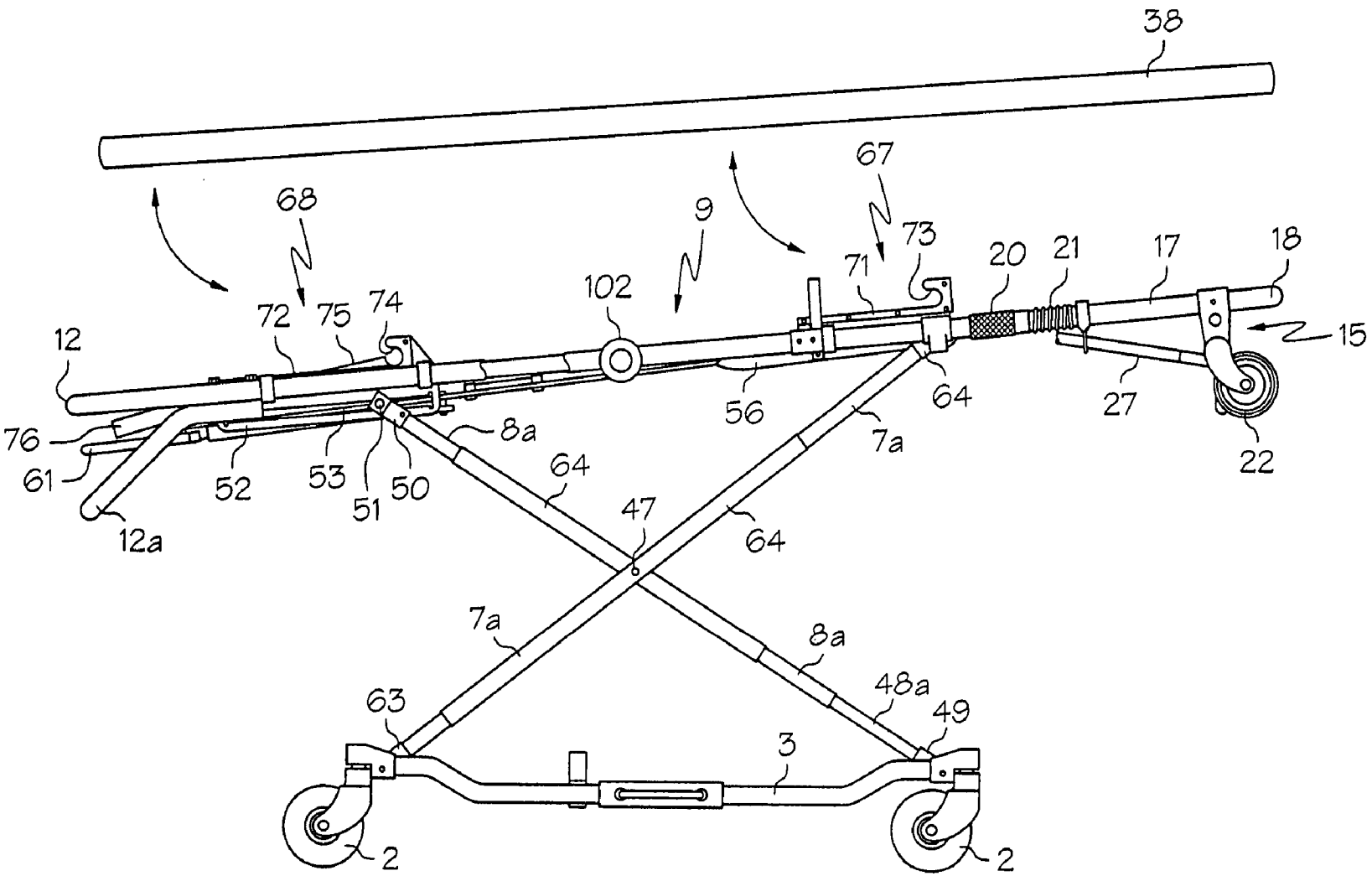
FIG. 3 is a side view of another cot structure embodiment of the invention adapted to receive a removable stretcher top.

Referring now to FIG. 3, illustrated is another cot structure embodiment of the invention having no top patient supporting structure, with parts broken away and others in dotted lines for purposes of illustration. Since many of the features of the embodiment of FIG. 3 are similar to those discussed in reference to FIGS. 1*a*, 1*b*, 2*a*, and 2*b*, only the differences will be discuss for brevity, in which like symbols indicate similar elements. In the illustrated embodiment of FIG. 3, the cot frame 9 is adapted to receive a removable top 38, such as a stretcher/chair stair illustrated in commonly assigned U.S. Pat. No. 4,767,148, which is herein fully incorporated by reference.

As shown in FIG. 3, the cot frame 9 is provided with leading and trailing sets of seats, indicated generally by 67 and 68, respectively. Seats 67 and 68 are adapted to receive correspondingly positioned frame members (not shown) of the removable top 38. It will be understood that the removable top 38, irrespective of whether it is a simple stretcher, a stretcher/stair chair or other form of cot, will be provided with opposing longitudinal frame members arranged to be seated on and secured to the sets of seats 67 and 68 of the cot frame. Seats 67 and 68 comprise horizontally disposed pairs of supporting plates (not shown), having a pair of vertically disposed brackets 71 and 72. Brackets 71 each have a C-shaped slot 73 therein. Brackets 72 also each have a C-shaped slot 74, but in this instance they are preceded by inclined cam rails 75 which serves to lock transversely extending frame members of the removable top 38 in the slots 74 until they are lifted from the slots, permitting the removable top 38 to be separated from the cot frame 9.

In the embodiment of FIG. 1, the backrest 29, as well as the remaining upper surface of the cot frame 9 in this embodiment is covered with a support surface covering for accommodating a support mattress and/or a patient, which is illustrated by 201 in FIG. 2. For the embodiment of FIG. 3, the support surface covering may be optional as cot frame 9 is adapted to removably attach the conventional removable stretcher.

Figure 5:
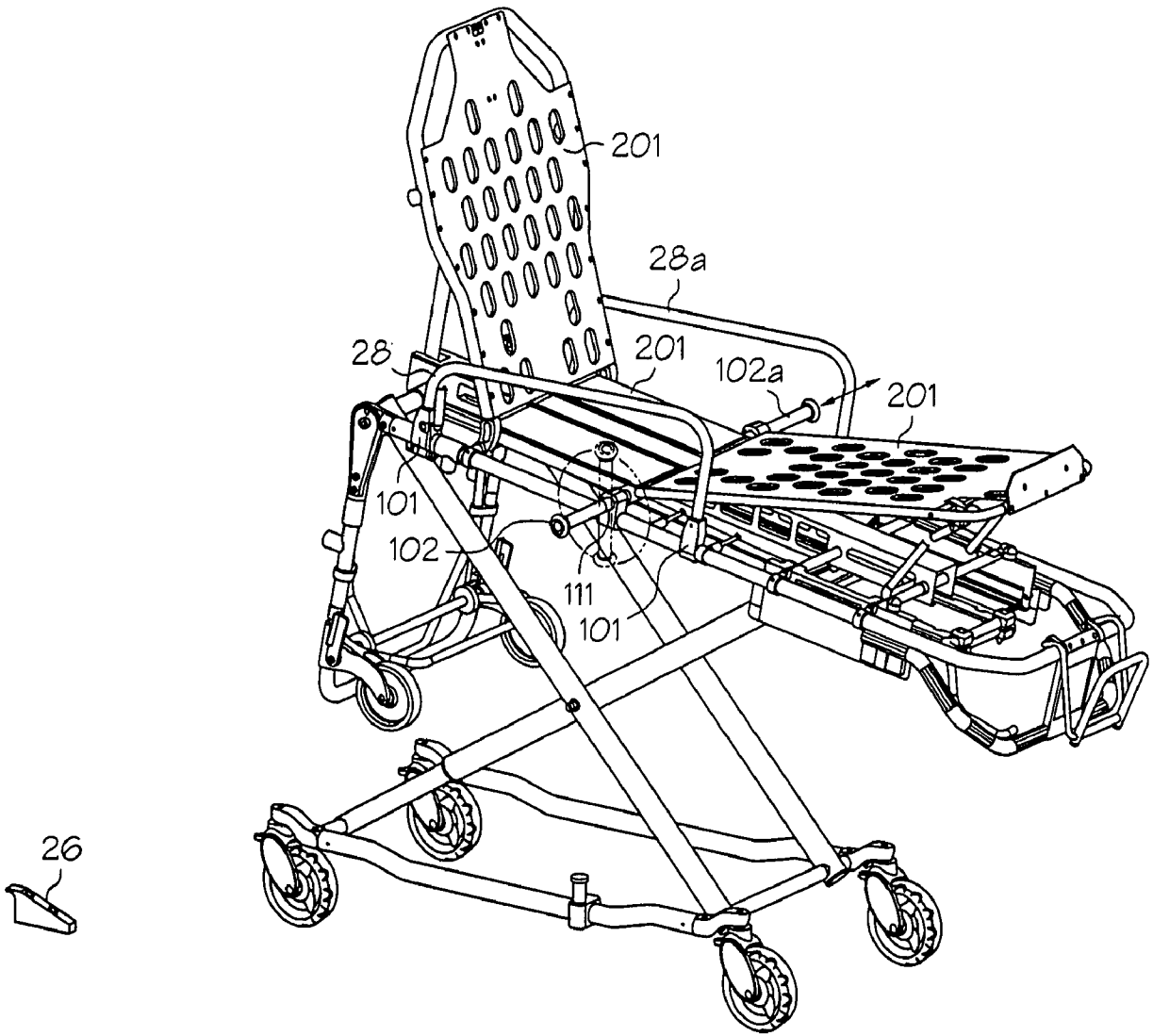
FIG. 5 is an elevational perspective view of another cot structure embodiment of the invention having a stretcher top.

Turning now to other features of the present invention, as best illustrated by FIGS. 2*a*, 4, and 5, and providable to any of the foregoing cot constructions, a pair of side extension arms 102 and 102*a* is shown. Side extension arms 102 and 102*a* are slidable housed within an interior cavity of the transverse tubular member 42 (FIG. 4). Each of the arms 102 and 102*a* may be extended from a stowed position as illustrated by side extension arm 102*a*, outwardly from the cot frame 9 to an extended position, as illustrated in FIG. 2*a* by side extension arm 102. The side extension arms 102 and 102*a* when extended are substantial perpendicular to its respective side frame member 10 and 11 between the foot and trailing ends of the cot frame 9. In the extended and stowed positions, the side extension arms 102 and 102*a* are maintained so positioned by known releasable securing methods, such as detents, spring biasing, locking pins, chocking collars, and the like.

Additionally, in another embodiment, each of side extension arms 102 and 102*a* may be provided with a pull out position, which exposes a hinge member 111, as illustrated by FIG. 5. The hinge member 111 of each side extension arms 102 and 102*a* is normally accommodated within the tubular member 42. However, when slidable exposed by fully extending a side extension arm, for example, 102 to the pull out position, hinge member 111 permits arm 102 to be folded 90° from its substantially horizontal extended position illustrated by arm 102*a*. In this folded position, side extension arm 102*a* may be rotated thereabout as illustrated.

In the stowed position, the side extension arms 102 and 102*a* provide a small profile in order to be unobtrusive to attendants working around the cot frame 9. In the extended position, the side extension arms 102 and 102*a* provide a convenient handling surface for attendants to situate themselves around the cot frame 9 in order to control the movement and lifting of the undercarriage into an emergency vehicle. It is to be appreciated that these side extension arms 102 and 102*a* provide the cot frame 9 with added handling points by which extra attendants may help to lift a large body person situated on the cot frame to and from the emergency vehicle.

Figure 6:
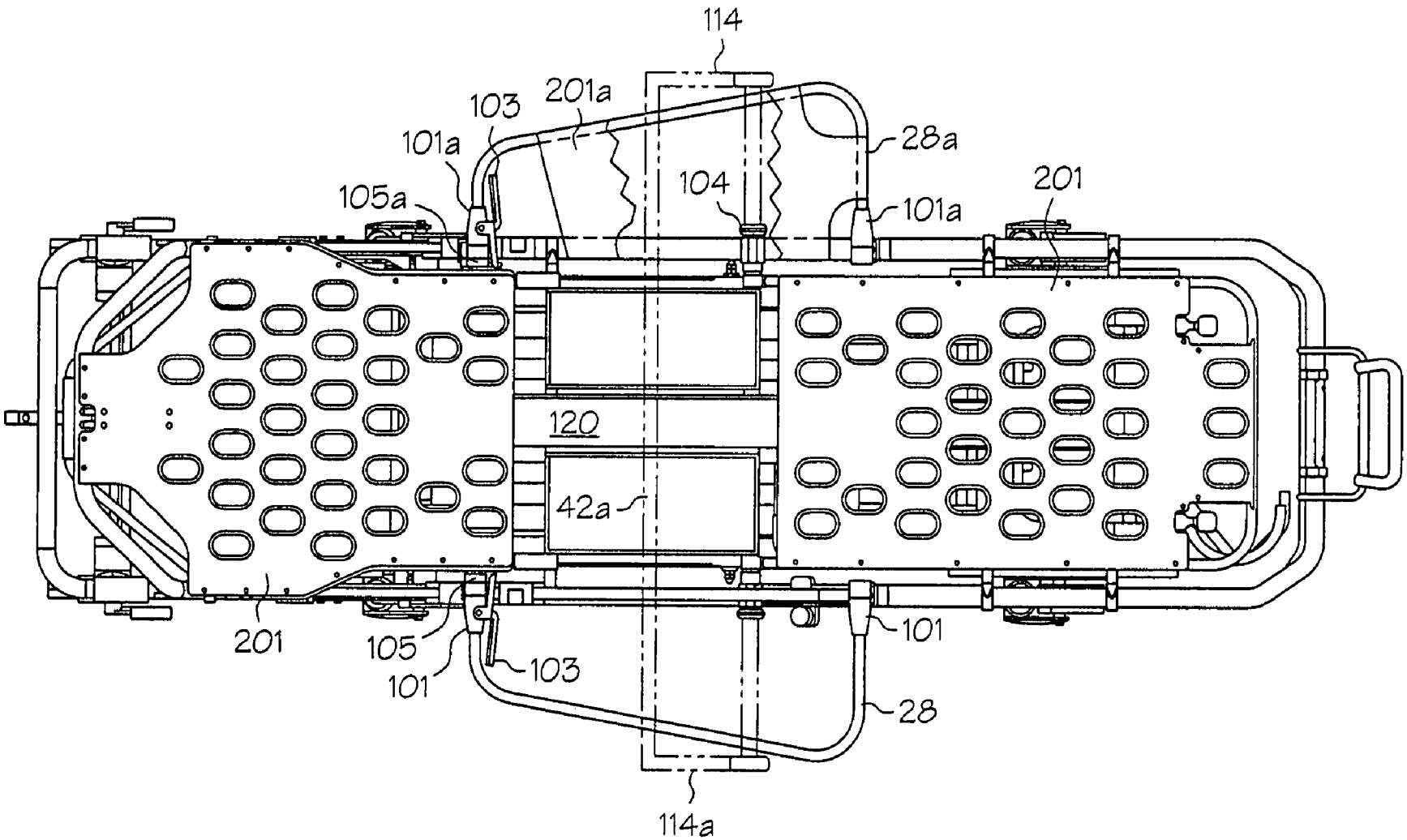
FIG. 6 is a top view of another cot structure embodiment of the invention, with parts in dotted lines for purposes of illustration.

Referring back to FIG. 1*b*, it is to be appreciated that each of the folding sidearm supports 28 and 28*a* is rotatably connected to the cot frame 9 by a respective pair of sidearm mounts 101 and 101*a*. The sidearm mounts 101 and 101*a* are mounted to their respective longitudinal side frame member 10 or 11. The sidearm supports 28 and 28*a* each rotates about their respective longitudinal side frame members 10 and 11, thereby providing 180° rotational freedom from a vertically-up position, as illustrated, to a vertically-down position illustrated by the dotted lines in FIG. 1*b*. A side-arm release 103 is provided to each of the sidearm mounts 101 and 101*a*. With reference to FIG. 6, when a technician pulls the side-arm release 103, spring biased holding pins 121 (FIG. 8*b*) are unseated from a set of recesses 123 (FIG. 8*b*) in the latch block 105 and 105*a* mounted at the end portion of the respective folding sidearm that is rotatably mounted to the side frame member. It is to be appreciated that with the set of recesses, the folding sidearm supports 28 may be releasably positioned substantially vertical and horizontal to the cot frame 9 (i.e., approximately 90° from vertical).

Each folding sidearm support 28 and 28*a* may be positioned above or below their respective side extension arm 102 and 102*a*. Situating the folding sidearm supports 28 and 28*a* below their respective side extension arms, as illustrated by 102, the folding sidearm supports are structural reinforced by the side extension arms such that two or more attendants may use the folding sidearm supports as a lifting surface. Such a lifting configuration is useful in situations when handling a person of an extreme amount of weight (i.e., greater than 300 lbs). Situating the folding sidearm supports 28 and 28*a* above their respective side extension arms, as illustrated by 102*a* by dotted line, the folding sidearm supports are provided with structural support. Such a supporting configuration is useful to increase the support surface area of the cot support surface to accommodate person requiring additional cot space (i.e., obesity). Further, the supporting configuration is useful if necessary to hang emergency equipment/medical devices, and/or personal belongs of the victim.

Figure 8A:
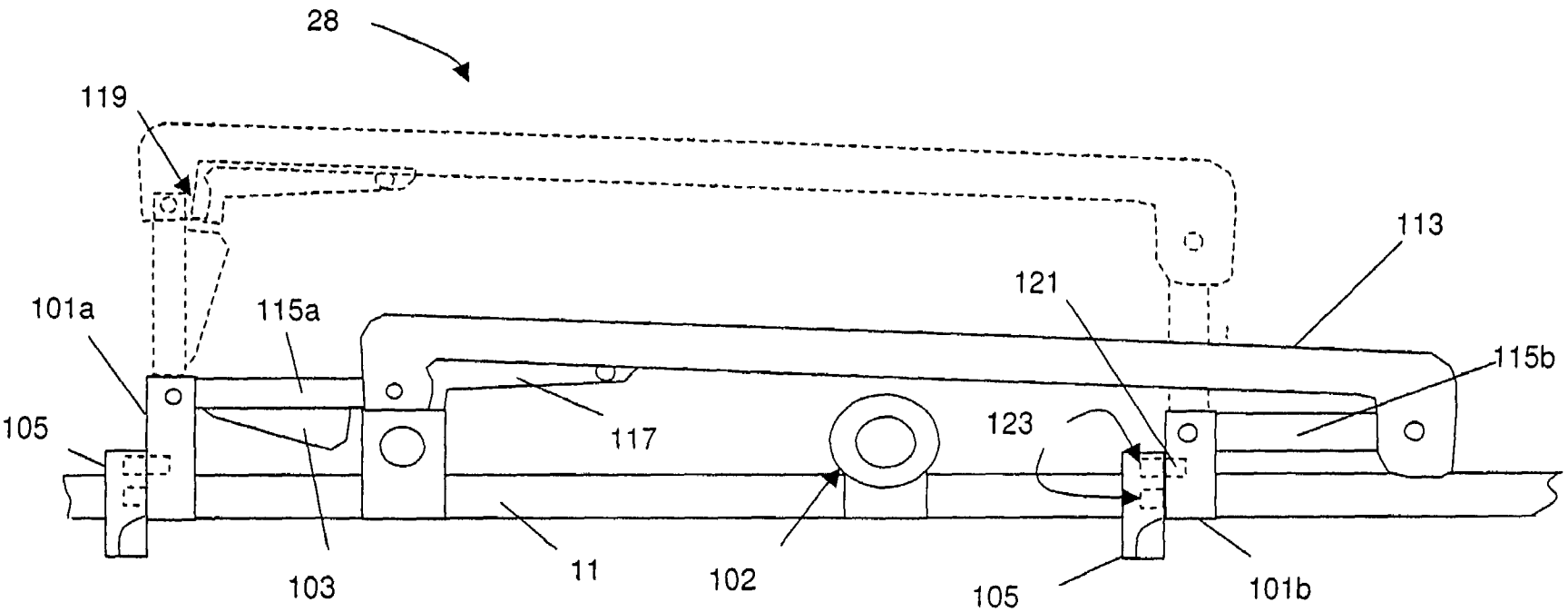
FIGS. 8*a* and 8*b* are side views of sidearm support embodiments according to the present invention adapted to fold compactly.

In another embodiment, in addition to being positionable in the above-described vertically-up, vertically-down, and intermediate horizontal positions, each sidearm support 28, 28*a* is also positionable in a folded, compact position. In the embodiment shown by FIG. 8*a*, the sidearm support 28 is positionable from the vertically up position illustrated in dashed lines, to the folded, compact position which places a sidearm support frame member 113 adjacent the side frame member 11. Please note, reference numerals that are the same as those used in FIGS. 1*b* and 6 represent the same components.

As illustrated, the sidearm support 28 includes a pair of spaced apart frame extensions 115*a*, 115*b* pivotably attached to the frame member 113. Both frame extensions 115*a*, 115*b* are also pivotally attached to respective sidearm mounts 101*a*, 101*b*. In addition to the first side-arm release 103, in this embodiment a second sidearm release 117 is accommodated within the inside perimeter of the sidearm support 28 above the first side-arm release 103.

As previously mentioned, manipulating the first sidearm release 103 permits the sidearm support 28 to be positioned in the vertically up, the vertically down, as is illustrated by FIG. 1*b* or the relatively horizontal position as is illustrated by FIG. 6. Manipulating the second sidearm release 117 clears an interference between an abutting portion 119 of the second sidearm release and the first frame extension 115*a*, such that the frame member 113 of the sidearm support 28 is positionable in the folded, compact position.

Figure 8B:
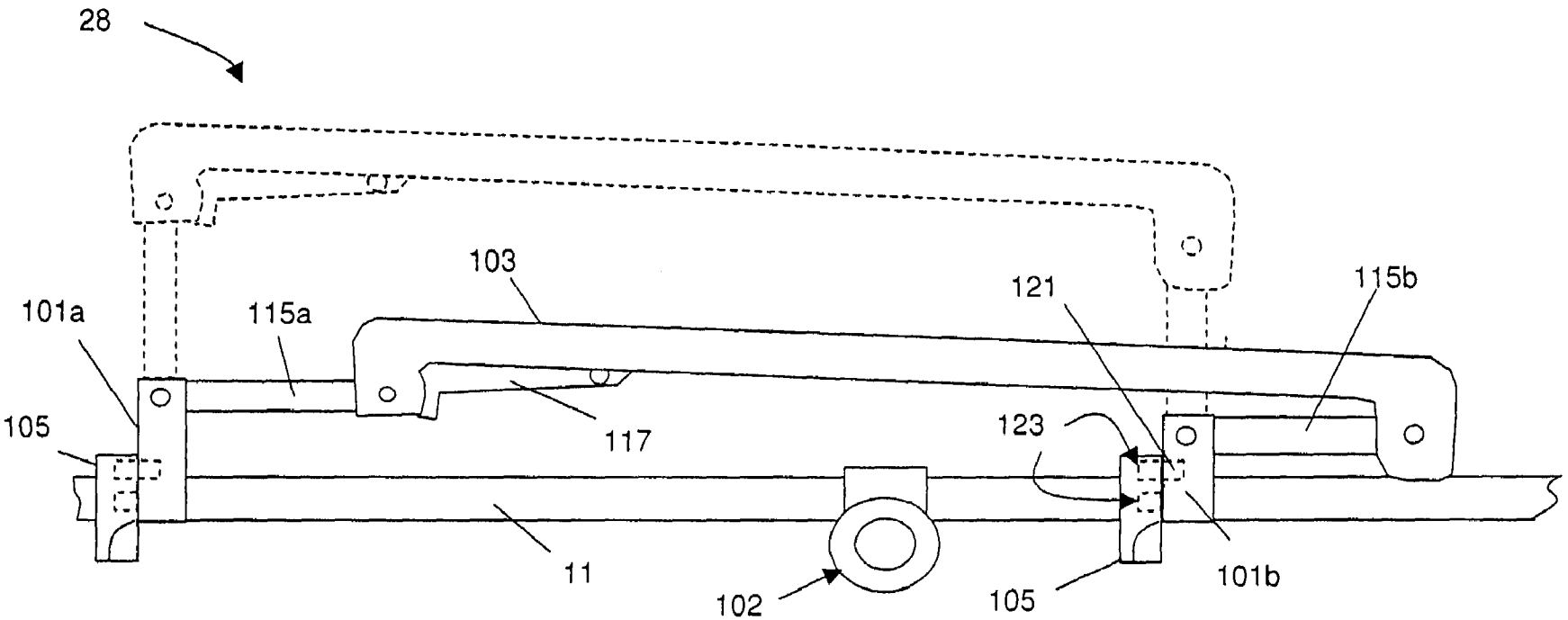

In another embodiment, which is illustrated by FIG. 8*b*, only the second sidearm release 117 is provided. As before, the sidearm support 28 is positionable in the vertically-up, vertically-down, an intermediate horizontal position, and the folded, compact position. However, unlike the embodiment shown by FIG. 8*a*, manipulating the second sidearm release 117 clears both the interference between the abutting portion 119 of the second sidearm release and the first frame extension 115, and unseats the pair of holding pins 121 from their engagement with the recesses 121 of their respective latch block 105, 105*a*. With such an arrangement, an operator is able to place the sidearm support 28 in either the folded, compact position, and/or the vertically up, the vertically down, as is illustrated by FIG. 1*b* or the relatively horizontal position as is illustrated by FIG. 6 by operating the sidearm release 117.

Referring back to FIG. 6, illustrating other embodiments of the invention, if desires, one or both sidearm supports 28 and 28*a* may be provided with an additional support surface covering 201*a*. Moreover, the end cap portion 104 of each side extension arm 102 and 102*a* may be shaped in a number of various configurations, which are illustrated in FIG. 2*a* as for example and not to be limited by, dotted lines 106, 108, 110, and 112. As shown, provided is a plug-end or doughnut-shaped portion 104, a T-shaped end portion 106, a mushroom shaped end portion 108, an angled-bracket end portion 110, and a U-shaped or umbrella handle end portion 112, each of the various end cap portion configurations providing their own unique advantages.

As illustrated by FIG. 6, a pair of double-sided extension arms may be provided to the cot frame 9, which are illustrated by dotted lines 114 and 114*a*. In this configuration, an additional transverse hollow tubular member 42*a* is included in the cot construction, wherein the pair of transverse members 42 and 42*a* slidably house within their interior cavity the arm portions 116 of each double-sided extension arm 114 and 114*a*. As also illustrated, the arm portions 116 of each double-sided extension arms extend substantially perpendicular to its respective side frame members 3 and 4. In the stowed position, a handle portion 118 being the portion which spans between the arm portions 116 of the double side extension arm 114, is situated adjacent its respective side frame member 3 or 4, substantial flush, thereby providing a unobtrusive profile.

Further, to provide the above described cot construction embodiments with an increased load bearing capacity, a central strength member 120 is provided to the cot frame 9. Preferably, the central strength member 120 is an I-beam construction. The transverse members of the cot frame 9 such as, for example, frame member 13, transverse members 42 and 42*a*, and additional traverse frame members 122, 124, and 126 are mounted (e.g., bolted, welded, etc.) to the central strength member 120. It is to be appreciated that centrally supporting and/or connecting these transverse members to the strength member 120 permits increased load bearing of the cot 100 by distributing more evenly the weight throughout the cot frame 9. Accordingly, the cot 100 of the present invention is capable of supporting loads upon the cot frame up to about 600 lbs.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is therefore, claimed in any of its forms or modifications within the proper scope of the appended claims appropriately interpreted in accordance with the doctrine of equivalents. Any modification of the present invention which comes within the spirit and scope of the following claims should be considered part of the present invention.

What is claimed is:

1. An elevating cot adapted to be rolled into emergency vehicles, said cot comprising:

a generally rectangular cot frame; and a pair of sidearm supports pivotally and rotatably connected to said cot frame, each of said sidearm supports being configured to be rotatable in a vertically-up position, a vertically-down position, a substantially horizontal position, and pivotable in a folded compact position relative to said cot frame.

2. The cot structure claimed in claim 1, wherein said cot frame includes an opposing pair of tubular side frame members and a tubular transverse frame member spanning between said side frame members, wherein said transverse frame member slidably accommodating a pair of side extension arms.

3. The cot structure claimed in claim 1, further comprising a pair of side extension arms provided to said cot frame between leading and trailing ends of said cot frame, each of said side extension arms being adapted to slidably extend outwardly from a stowed position adjacent said cot frame to an extended position substantially perpendicular to said cot frame.

* * * * *